US006290335B1

(12) United States Patent
Kawai et al.

(10) Patent No.: US 6,290,335 B1
(45) **Date of Patent: *Sep. 18, 2001**

(54) INK-JET HEAD, INK-JET CARTRIDGE, AND INK JET RECORDING APPARATUS

(75) Inventors: Jun Kawai, Tokyo; Masami Ikeda, Yokohama; Hajime Kaneko, Kodaira; Hiroyuki Ishinaga, Tokyo; Masaaki Okada, Sanjo; Masahiko Kubota, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/844,597

(22) Filed: Apr. 21, 1997

(30) Foreign Application Priority Data

Apr. 22, 1996 (JP) ..... 8-100172

(51) Int. Cl.[7] ..... B41J 2/05; B41J 2/14
(52) U.S. Cl. ..... 347/62; 347/48
(58) Field of Search ..... 347/62, 65, 48, 347/15

(56) References Cited

U.S. PATENT DOCUMENTS

| | | | |
|---|---|---|---|
| 4,317,124 | 2/1982 | Shirato et al. | 347/67 |
| 4,450,455 | 5/1984 | Sugitani et al. . | |
| 4,558,333 | 12/1985 | Sugitani et al. . | |
| 4,568,953 | 2/1986 | Aoki et al. . | |
| 4,611,219 | 9/1986 | Sugitani et al. . | |
| 4,646,110 | 2/1987 | Ikeda et al. . | |
| 4,881,318 | 11/1989 | Komuro et al. . | |
| 4,929,964 | 5/1990 | Sato et al. . | |
| 5,068,674 | 11/1991 | Sato et al. . | |
| 5,121,143 | 6/1992 | Hayamizu | 347/62 X |
| 5,172,139 | 12/1992 | Sekiya et al. | 347/62 |
| 5,262,802 | 11/1993 | Karita et al. . | |
| 5,389,957 | 2/1995 | Kimura et al. . | |
| 5,485,184 | 1/1996 | Nakagomi et al. . | |
| 5,731,828 * | 3/1998 | Ishinaga | 347/62 |
| 5,754,201 * | 5/1998 | Ishinaga | 347/62 |

FOREIGN PATENT DOCUMENTS

| | | | |
|---|---|---|---|
| 0 124 312 | 11/1984 | (EP) | B41J/3/04 |
| 0 613 781 | 9/1994 | (EP) | B41J/2/205 |
| 0 707 963 | 4/1996 | (EP) | B41J/2/05 |
| 0 707 964 | 4/1996 | (EP) | B41J/2/05 |
| 0 747 221 | 12/1996 | (EP) | B41J/2/05 |
| 62-48585 | 3/1987 | (JP) | B41J/3/04 |
| 62-261452 | 11/1987 | (JP) | B41J/3/04 |
| 1-235652 | 9/1989 | (JP) | B41J/3/04 |

* cited by examiner

*Primary Examiner*—John Barlow
*Assistant Examiner*—Craig A. Hallacher
(74) *Attorney, Agent, or Firm*—Fitzpatrick, Cella, Harper, & Scinto

(57) ABSTRACT

The present invention provides an ink-jet head having a plurality of heaters for one ejection outlet, wherein the heaters and the outlet are disposed so as to satisfy a specific relationship, and thereby errors in the path of ejected ink droplets concerning the driving positions of the heaters can be restricted.

11 Claims, 7 Drawing Sheets

INK-JET HEAD, INK-JET CARTRIDGE, AND INK JET RECORDING APPARATUS

BACKGROUND OF THE INVENTION

1. Field of the Invention

The present invention relates to ink-jet heads and apparatuses used in printers, video printers and others serving as output terminal units for copying machines, facsimile machines, word processors, host computers and others. In particular, the present invention relates to an ink-jet head and an ink-jet apparatus having a base member comprising an electrothermal converting element which generates thermal energy utilized as recording energy. Incidentally, the term "recording" used here implies ink application and other activities (printing) onto any type of ink-receiving material such as cloth, thread, paper, and sheet materials, and the term "recording apparatus" implies various types of information-processing apparatuses and printers serving as output units used in such apparatuses. Accordingly, the present invention is applicable for these usages.

2. Description of the Related Art

Recently, ink-jet recording apparatuses are increasingly required to be of smaller size, lower price, and in addition, have abilities for color recording and higher image quality recording. Hitherto, since a precise and complex structure and control of the recording head was necessary for achieving high image quality, recording apparatuses were extremely expensive and of large size.

In relation to this, Japanese Examined Patent Publication No. 62-48585 discloses an ink-jet recording apparatus capable of modulating dot sizes while using a markedly simple mechanism in which two or more of electrothermal converting elements (including large one and small one) are disposed within one nozzle, and thus achieving high image quality. This invention is significant for gray-scale recording.

Practically, when ink-ejecting quantity is modulated for achieving high image quality while using two electrothermal converting elements within one nozzle, each of the parallel-disposed electrothermal converting elements is generally individually driven. It has been revealed, however, that merely disposing the electrothermal converting elements in parallel cannot achieve an optimum ink-impacting position accuracy in some cases though a considerable accuracy can be achieved. In relation to this, the Inventors found that alteration of design parameters such as the distances between the electrothermal converting elements and an orifice, the size of the orifice, and others causes deterioration of the ink-impacting position accuracy, and therefore, the design must be wholly reformed in order to attain desired image quality. More specifically, alteration of some design parameters as described above leads to failure in satisfying practical levels, which may be attributed to complex factors arising from provision of two electrothermal converting elements within one nozzle and concerning nozzle designing for achieving high levels of ink-ejecting quantity and stability of the ejecting quantity. Further, the Inventors conducted the following examination in addition to examination of problems in related arts on designing the above-described electrothermal converting elements and the ink-impacting point. Ordinarily, factors on designing a nozzle and its periphery for achieving desired ink-impacting position accuracy are the orifice area, the nozzle length, the size and disposition of the electrothermal converting element, and others. The inventors examined designs of nozzles which contain a plurality of electrothermal converting elements while focusing the attention on the orifice area and the nozzle length among the above-listed factors, and found that a desired ink-impacting position accuracy can rarely be stably achieved possibly due to influence of other predominant factors. Meanwhile, among the parameters on designing a nozzle and its periphery, sizes of the electrothermal converting elements are determined at the point when a photomask used in a patterning step in a process for manufacturing a semiconductor substrate is designed. When the sizes of the electrothermal converting elements are altered aiming at achieving a desired ink-impacting position accuracy, the head must be produced almost newly. Accordingly, since the size and position of each electrothermal converting element should be altered at the last point of nozzle designing, there are considerable losses in view of time and workload. In contrast, only if the sizes and positions of the electrothermal converting elements can be determined beforehand, other ink-ejecting properties can easily be adjusted. For example, the orifice area can be minutely altered since methods for controlling the energy from a laser or the like for forming the orifice have been developed, and such an alteration is less causative of time loss and work inefficiency since forming the orifice is a relatively later step. Consequently, for a head having a plurality of electrothermal converting elements within one nozzle, it is particularly important to properly determine positions of the orifice and the electrothermal converting elements and others at an initial stage of nozzle designing.

As described above, requirements on structure of a head having a plurality of heaters within one nozzle for achieving a high image quality have not yet been considered in detail in view of the relationship between the orifice and the electrothermal converting elements. Based on the above findings, the present invention is directed to solve difficulties in achieving a high image quality while using a head having a plurality of heaters within one nozzle, and to achieve recording with a higher image quality.

The Inventors examined the parameters on head designing in order to improve ink-impacting position accuracy aiming at achieving high image quality recording, and found that stable achievement of a high image quality requires considering tendency of the influence upon ink-impacting position accuracy by the orifice area and positions of the two electrothermal converting elements relative to the orifice. The present invention has been accomplished based on this finding.

SUMMARY OF THE INVENTION

Accordingly, an object of the present invention is to provide an ink-jet recording head, an ink-jet head cartridge and an ink-jet recording apparatus capable of achieving highly fine recording by specifying a head structure in which the positional relationship between a plurality of heaters and the a real center of an ejection outlet is carefully considered.

The principal construction of the present invention for achieving the above object is as follows.

(1) An ink-jet head comprising:

an ejection outlet portion which has an ejection outlet, and is convergent toward said outlet;

an ink channel communicating with said outlet;

a first heater and a second heater which are disposed in said ink channel and can be individually driven; and an element substrate equipped with said heaters, wherein:

said first heater and second heater have different heating powers and are distantly disposed from each other; and the following formula is satisfied with the angle $\theta_1$ formed between the areal center of said first heater and the projection point of the areal center of said ejection outlet onto the element substrate surface provided with said heaters via the areal center of said ejection outlet, the angle $\theta_2$ similarly formed but using the areal center of said second heating member, the sectional area $S_N$ of said ink channel perpendicular to the ink-ejecting direction, and the area $S_O$ of said ejection outlet.

$$\tan^{-1}\frac{S_N S_0(\mathrm{Sin}\theta_1+\mathrm{Sin}\theta_2)}{S_N^2-S_0^2\mathrm{Sin}\theta_1\mathrm{Sin}\theta_2}\leqq 5^\circ$$

(2) An ink-jet head comprising:

an ejection outlet portion which has an ejection outlet, and is convergent toward said outlet;

a pressure chamber communicating with said outlet;

a first heater and a second heater which are provided in said pressure chamber, disposed so as to oppose said ejection outlet, and can be individually driven; and an element substrate equipped with said heaters, wherein:

said first heater and second heater have different heating powers and are distantly disposed from each other; and the following formula is satisfied with the angle $\theta_1$ formed between the areal center of said first heater and the projection point of the areal center of said ejection outlet onto the element substrate surface provided with said heaters via the areal center of said ejection outlet, the angle $\theta_2$ similarly formed but using the areal center of said second heating member, the sectional area $S_N$ of said pressure chamber perpendicular to said element substrate equipped with said heating members, and the area $S_O$ of said ejection outlet.

$$\tan^{-1}\frac{S_N S_O(\mathrm{Sin}\theta_1+\mathrm{Sin}\theta_2)}{S_N^2-S_O^2\mathrm{Sin}\theta_1\mathrm{Sin}\theta_2}\leqq 3^\circ$$

(3) An ink-jet recording apparatus which can carry an ink-jet head according to the above paragraph (1) or (2), and has a means to send different driving signals to said first heater and second heater.

(4) An ink-jet head cartridge comprising:

an ink-jet head according to the above paragraph (1) or (2); and an ink-vessel holding ink to be supplied to said ink-jet head.

Based on the above construction, ink-impacting position accuracy can be improved by inhibiting irregularity in the ink-impacting position in a case where each heater is individually driven, and thus gray-scale recording can be achieved with a high image quality.

DESCRIPTION OF THE PREFERRED EMBODIMENT

EXAMPLE 1

Figure 1:
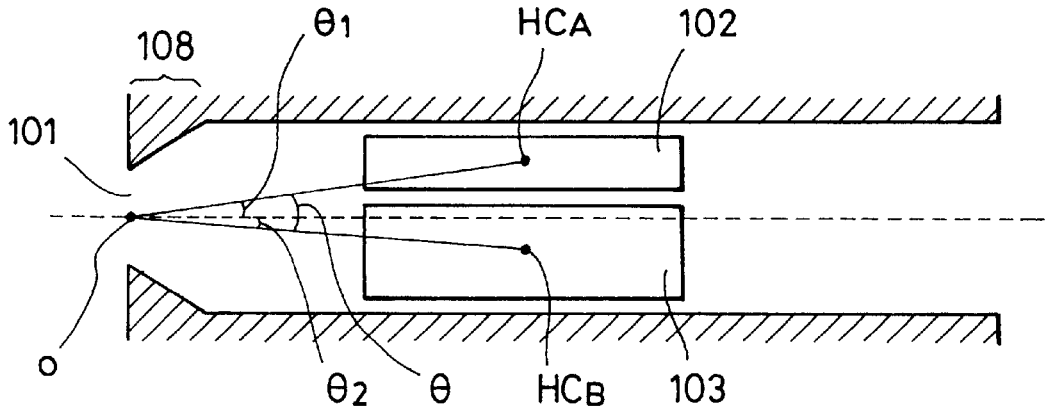
FIG. 1 is a schematic sectional view illustrating the structure around the ink channel of an ink-jet recording head according to the present invention.

FIG. 1 is a schematic sectional view of an ink-jet recording head and its periphery most properly showing the feature of the present invention. In this figure, 101 indicates an ejection outlet; 108 indicates an ejection outlet portion having the ejection outlet; 102 indicates an electrothermal converting element as a first heater generating a thermal energy according to application of a predetermined electric current; and 103 indicates an electrothermal converting element as a second heater.

Further, O indicates the areal center of the ejection outlet 101, and $HC_A$ and $HC_B$ indicate the areal centers of the electrothermal converting elements 102 and 103, respectively. Incidentally, the centers of the effective heating areas, which especially directly contribute to generation of bubbles, may also be regarded as areal centers.

Figure 3:
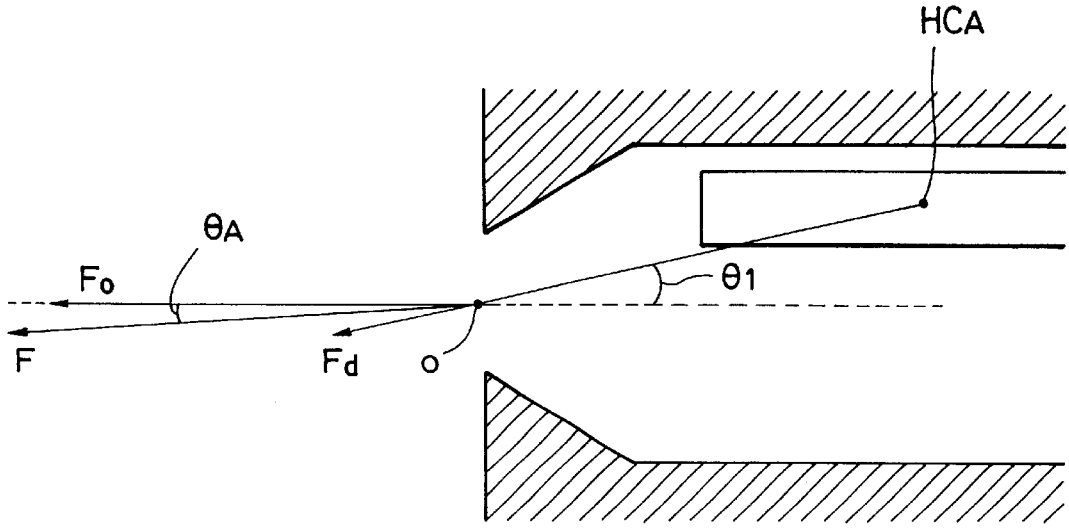
FIG. 3 is a schematic sectional view illustrating the structure of an ink channel in detail.

Additionally, FIG. 3 is a detailed view of the principal portion for further illustration of the present invention. In this figure, only the first heater among the above-mentioned heaters is shown in order to simplify illustration of the present invention, $\theta_1$ is an angle of the line O-$HC_A$ relative to the center line of the ink channel, and $\theta_A$ is an angle between the ink-ejecting direction and the center line of the ink channel when ink drops are ejected based on such an ink channel structure.

Figure 4A:
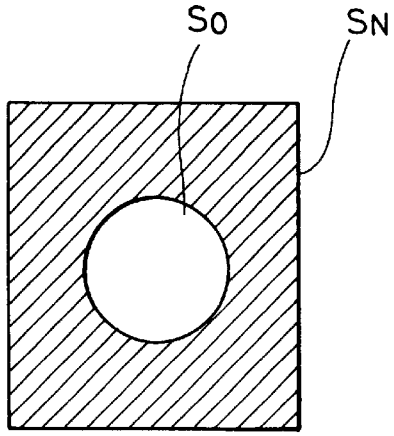
FIG. 4, consisting of FIGS. 4A and 4B, contains schematic diagrams showing the relationship between an ejection outlet portion and a sectional area of an ink channel in the present invention.
Figure 4B:
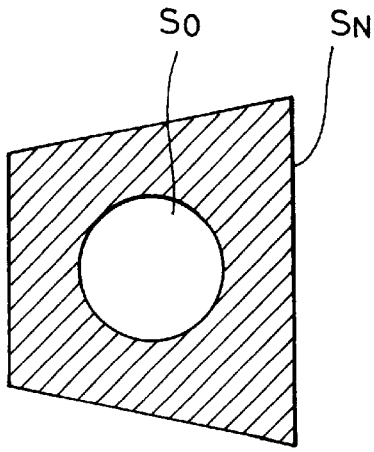
Figure 5:
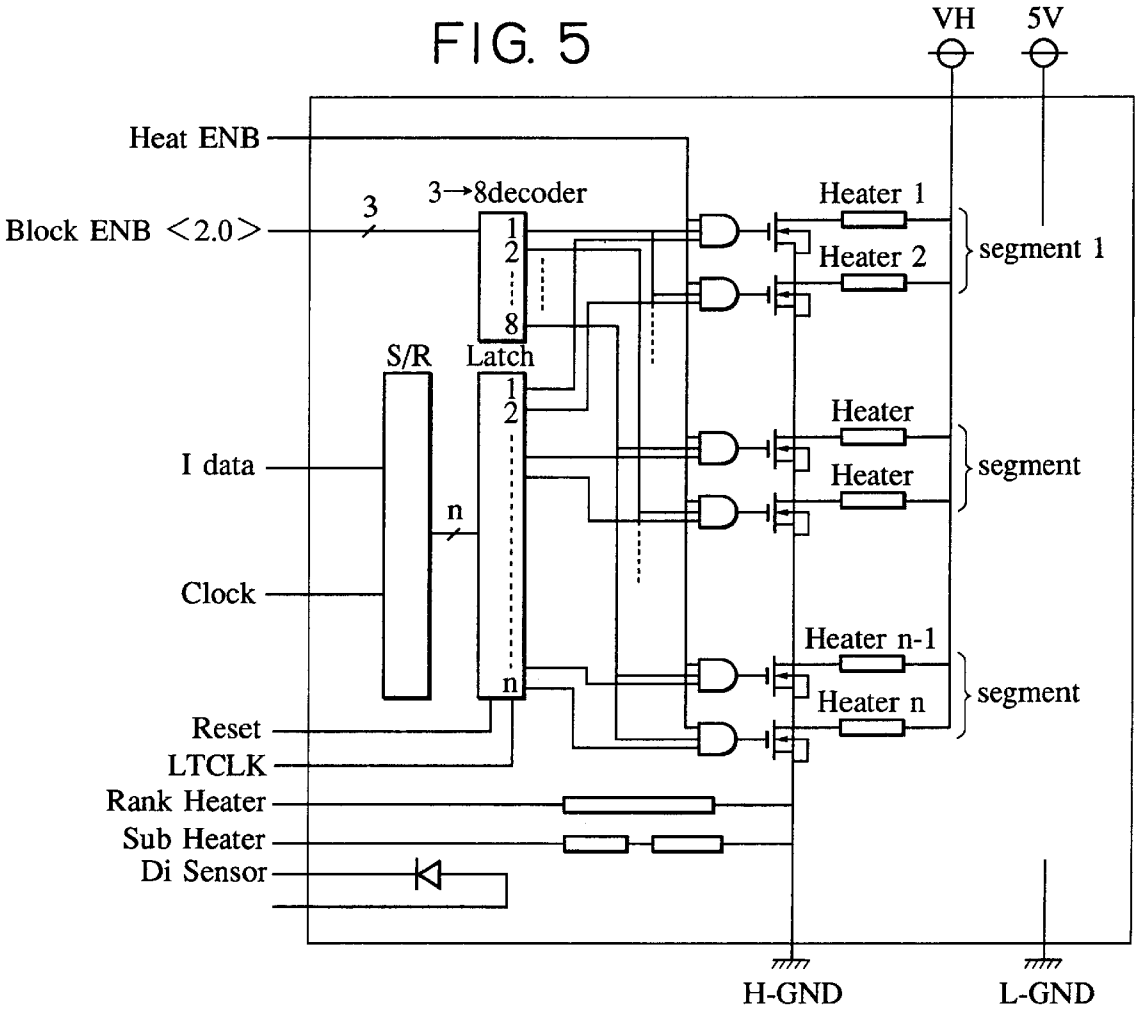
FIG. 5 is a schematic diagram showing an equivalent circuit on an element substrate equipped with heaters.

Moreover, FIGS. 4A and 4B are schematic drawings showing the ejection outlets and the sections of ink channels employed in this example. In these figures, $S_O$ indicates the area of the ejection outlet, and $S_N$ indicates the cross sectional area in the direction perpendicular to the longitudinal direction of the ink channel.

Here, the relationship between $\theta_1$ and $\theta_A$ will be determined with reference to FIG. 3. The angle $\theta_A$ is formed between the center line of the ink channel and the direction of F which is the resultant force of the pressure $F_d$ in the $\theta_1$ direction and the pressure $F_O$ along the center line of the ink channel. Accordingly, $\theta_A$ can be determined by determining the ratio between $F_O$ and $F_d$.

Additionally, when $F_X$ is defined as the ink-ejecting-directional component of the bubbling pressure derived from the electrothermal converting element 102, $F_X$ substantially equals F, and therefore the pressure $F_d$ upon the area $S_O$ of the ejection outlet can be expressed according to the following formula.

$$F_d = \frac{S_O}{S_N} \cdot F_x$$

Meanwhile, the other pressure can be expressed as $F_O$ as follows.

$$F_o = \frac{S_N - S_O}{S_N} F_x$$

Accordingly, the $F_d/F_O$ ratio can be expressed by $S_O/(S_N-S_O)$. Using this ratio, $\theta_1$ and $\theta_2$, the equation relative to the direction of the resultant force F can be expressed as follows.

$$\tan\theta_A = \frac{S_O \sin\theta_1}{S_N - S_O(1-\cos\theta_1)}$$

Hereupon, according to the ordinary rules on designing nozzles (ink channels), $\theta_1$ is less than 12°, and therefore, the value of $[1-\cos\theta_1]$ is substantially zero. Accordingly, the above equation can be expressed as follows.

$$\tan\theta_A = \frac{S_O}{S_N}\sin\theta_1$$

Similarly, the relationship between $\theta_B$ and $\theta_2$ can be expressed as follows, wherein $\theta_B$ is the ink-ejecting direction according to bubbling by the non-illustrated second electrothermal converting element, and $\theta_2$ is the angle formed between the center line of the ink channel and the line O-$HC_B$.

$$\tan\theta_B = \frac{S_O}{S_N}\sin\theta_2$$

Consequently, when ink is ejected according to bubbling by both first and second electrothermal converting elements, the narrowed angle $\theta_f$ in the ink-ejecting direction calculated by $\theta_A+\theta_B$ can be determined as follows.

$$\tan\theta_f = \tan(\theta_A + \theta_B)$$

$$= \frac{S_O S_N(\mathrm{Sin}\theta_1 + \mathrm{Sin}\theta_2)}{S_N^2 - S_O^2 \mathrm{Sin}\theta_1 \mathrm{Sin}\theta_2}$$

$$\theta_f = \tan^{-1}\frac{S_O S_N(\mathrm{Sin}\theta_1 + \mathrm{Sin}\theta_2)}{S_N^2 - S_O^2 \mathrm{Sin}\theta_1 \mathrm{Sin}\theta_2}$$

Here, ink-impacting position error levels required for image qualities are shown in Table 1 below.

TABLE 1

| Picture Element Density (dpi) | Picture Element Pitch (μm) | Ink-impacting Position Error for One Picture Element at 1.0 mm Distance (deg) | Ink-impacting Position Error for Half Picture Element at 1.0 mm Distance (deg) |
|---|---|---|---|
| 300 | 84.7 | 4.9 | 2.4 |
| 360 | 70.5 | 4.0 | 2.0 |
| 400 | 63.5 | 3.6 | 1.8 |

As shown in Table 1, in a case where ink drops are from one ejection outlet, the ink-impacting position level should fall within 4.9° when the maximum ink-impacting position error is assumed as one picture element value. Further, when the maximum ink-impacting position error is assumed as half picture element value, the ink-impacting position error level should fall within 2.4°. Accordingly, the above-determined $\theta_f$ should satisfy $0° < \theta_f \leqq 5°$, and more preferably, $0° < \theta_f \leqq 3°$.

Based on the above-described designing rule, the positions of the electrothermal converting elements and the orifice area were determined, and several types of ink-jet heads were manufactured. The design parameters and the resulting image qualities of the practically manufactured ink-jet heads are shown in Table 2 below.

TABLE 2

| Type | $\theta_1$ (deg) | $\theta_2$ (deg) | $S_O$ (μm) | $S_N$ (μm) | $\theta_f$ (deg) | Quality |
|---|---|---|---|---|---|---|
| A | 2 | 4 | 900 | 2500 | 2.2 | Very Good |
| B | 4 | 6 | 900 | 2500 | 3.6 | Good |
| C | 6 | 8 | 900 | 2500 | 5.0 | Good |
| D | 8 | 10 | 900 | 2500 | 6.4 | Bad |
| E | 6 | 8 | 400 | 2500 | 2.2 | Very Good |
| F | 6 | 8 | 700 | 2500 | 3.9 | Good |
| G | 6 | 8 | 1000 | 2500 | 5.6 | Bad |

Incidentally, when nozzles are designed according to the ordinary designing rule, the distance between the first and second electrothermal converting elements is required to be 2 μm or more in view of deposition performance, and the width of each electrothermal converting element requires an additional 2 μm or more around the effective heating zone, namely, 4 μm or more in total.

Further, the distance between the areal center of each electrothermal converting element and that of the ejection output is at most 300 μm, and therefore, the angle θ between the areal centers of the first and second electrothermal converting elements via the areal center of the ejection outlet is determined as follows.

$$\theta = \tan^{-1}(3/300) = 0.6°$$

$$\theta_1 = \theta_2 = \theta/2 = 0.3°$$

Moreover, when the sectional area $S_N$ of the ink channel is set as 2500 $\mu m^2$, the area $S_O$ of the ejection outlet requires at least 400 $\mu m^2$. Accordingly, the minimum value of the narrowed angle $\theta_f$ in the ink-ejecting direction is calculated at 0.1° by substitution of the above-described values, namely, $0.1° \leqq \theta_f$.

Figure 6:
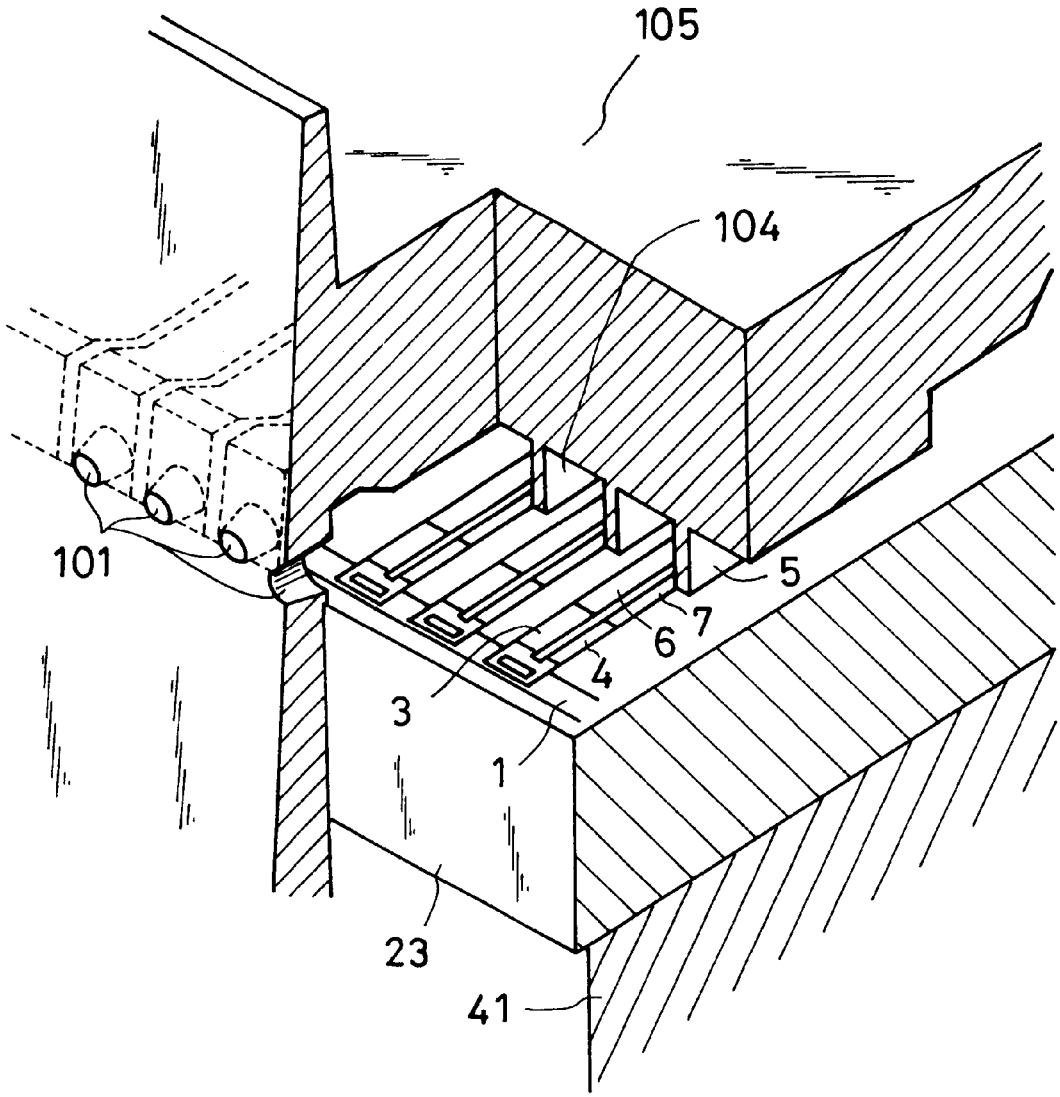
FIG. 6 is a schematic view illustrating the structure of a nozzle and its periphery in an ink-jet recording head of the present invention.

Next, the practical structure of the above-described heads will be illustrated below. The structure around the nozzles is shown in FIG. 6. Ink in an ink-ejecting nozzle 104 is heated for bubble generation by electrothermal converting elements 3 and 4, and ejected from a laterally opened ejection outlet 101. The reference number 1 indicates an common lead wire 1 electrically connected to each heater, and 6 and 7 indicate selective lead wires for individually driving each heater. A substrate 23 is stuck to a base plate 41, and nozzle walls 5 are formed so as to be integrated with a grooved member 105.

Figure 7:
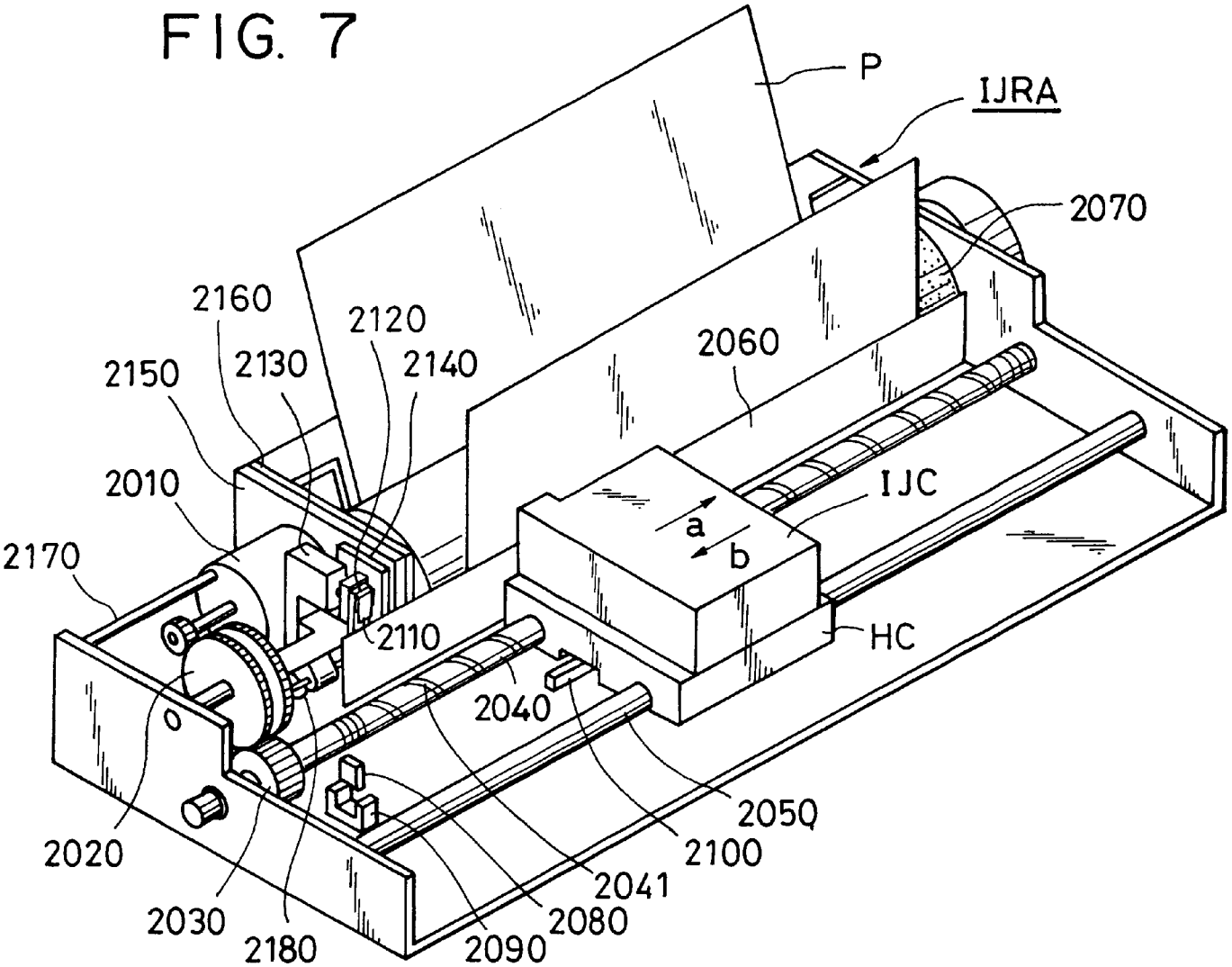
FIG. 7 is a schematic view illustrating an ink-jet recording apparatus of the present invention.

FIG. 7 is a perspective view of an example ink-jet recording apparatus carrying an ink-jet recording head which has the above-described structure. This ink-jet recording apparatus IJRA has a leading screw 2040 whose rotation is interlocked with front or reverse rotation of a driving motor 2010 through driving-force-transmitting gears 2020 and 2030. A carriage HC carrying an ink-jet cartridge IJC comprising an ink-jet recording head integrated with an ink tank is supported with a carriage shaft 2050 and the leading screw 2040, has a pin (not illustrated) engaged to a spiral groove 2041 on the leading screw 2040, and moves left and right, namely, in the directions of arrows a and b in accordance with rotation of the lead screw 2040. The referential number 2060 indicates a sheet-pressing plate which presses a paper sheet P against a platen roller 2070 over the range where the carriage moves. The referential numbers 2080 and 2090 indicate parts of a photo-coupler which function as home-position-detecting means for processes such as switching the rotating direction of the motor 2010 according to recognition of the presence of a lever 2100 joined to the carriage HC when the lever comes to the position of the coupler. The referential number 2110 indicates a cap member to cap the entire surface of the recording head, and the member is supported by a supporting member 2120. The referential number 2130 indicates a sucking means for sucking the inside of the cap, and the recording head is sucked for recovery by the sucking means through an opening in the cap. A cleaning blade 2140 which cleans the end face of the recording head is disposed on a member 2150 so as to be capable of moving forward and backward, and these blade and member are supported by a main-body-supporting plate 2160. As a matter of course, the form of the blade 2140 is not limited to the above, and any type of publicly-known cleaning blade can be used in this example. Additionally, a lever 2170 functioning to recover the suction for recovery of the recording head is disposed so as to move in accordance with movement of a cam 2180 engaged with the carriage HC, and according to such a mechanism, the driving force derived from the driving motor 2010 is controlled by a publicly-known transmitting means such as clutch switching.

In the above-described structure, each process of capping, cleaning, and suction for recovery of the head is carried out desirably at a position corresponding to the process by action of the lead screw 2040 when the carriage HC enters a zone near the home position. Needless to say, any type of structure in which desired processes are carried out with known timing can be employed for this example.

EXAMPLE 2

Figure 2:
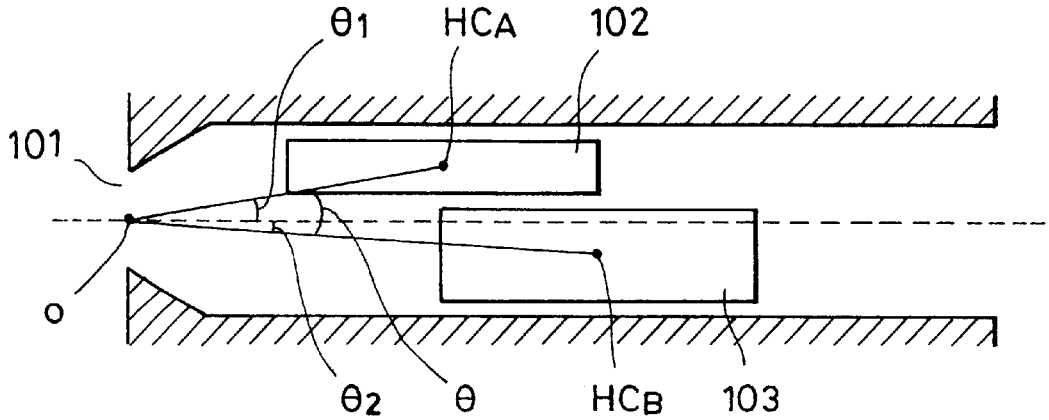
FIG. 2 is a schematic sectional view illustrating the structure around the ink channel of another ink-jet recording head according to the present invention.

FIG. 2 is a schematic sectional view illustrating the structure around the ink channel of another ink-jet recording head according to the present invention. Although the distance between $HC_A$ and the front end of the nozzle was different from that between $HC_B$ and the same, results similar in Example 1 could be obtained by properly determining $\theta_1$ and $\theta_2$.

EXAMPLE 3

Figure 8:
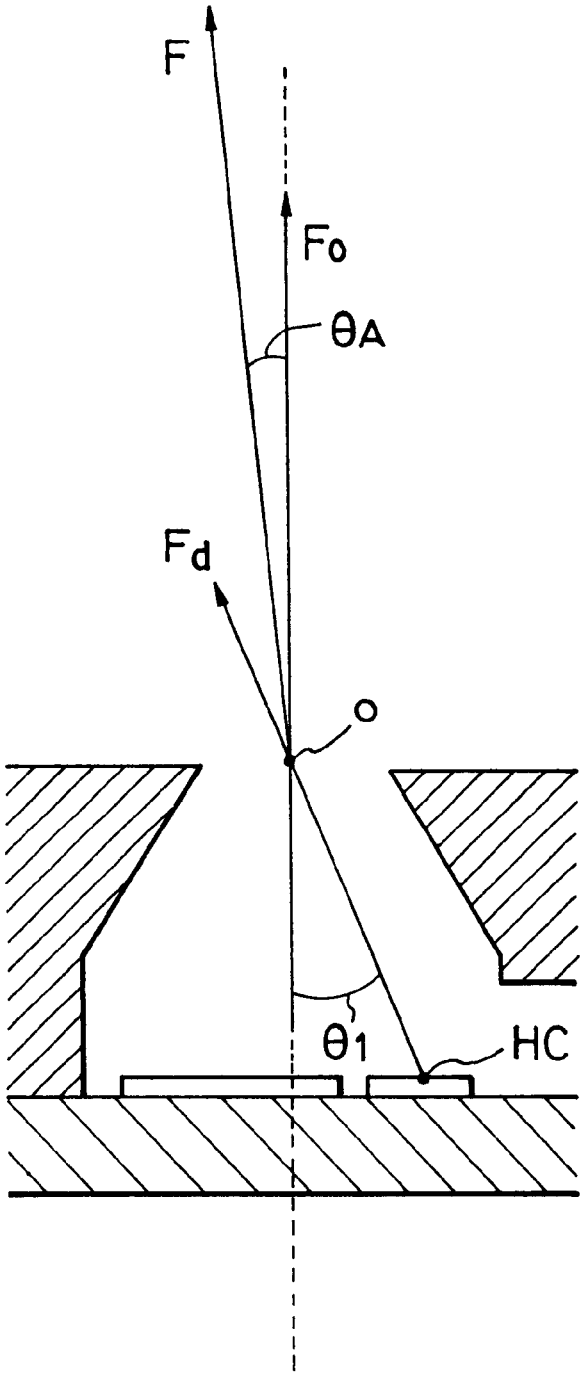
FIG. 8 is a schematic sectional view showing another example of an ink-jet recording head according to the present invention.
Figure 9:
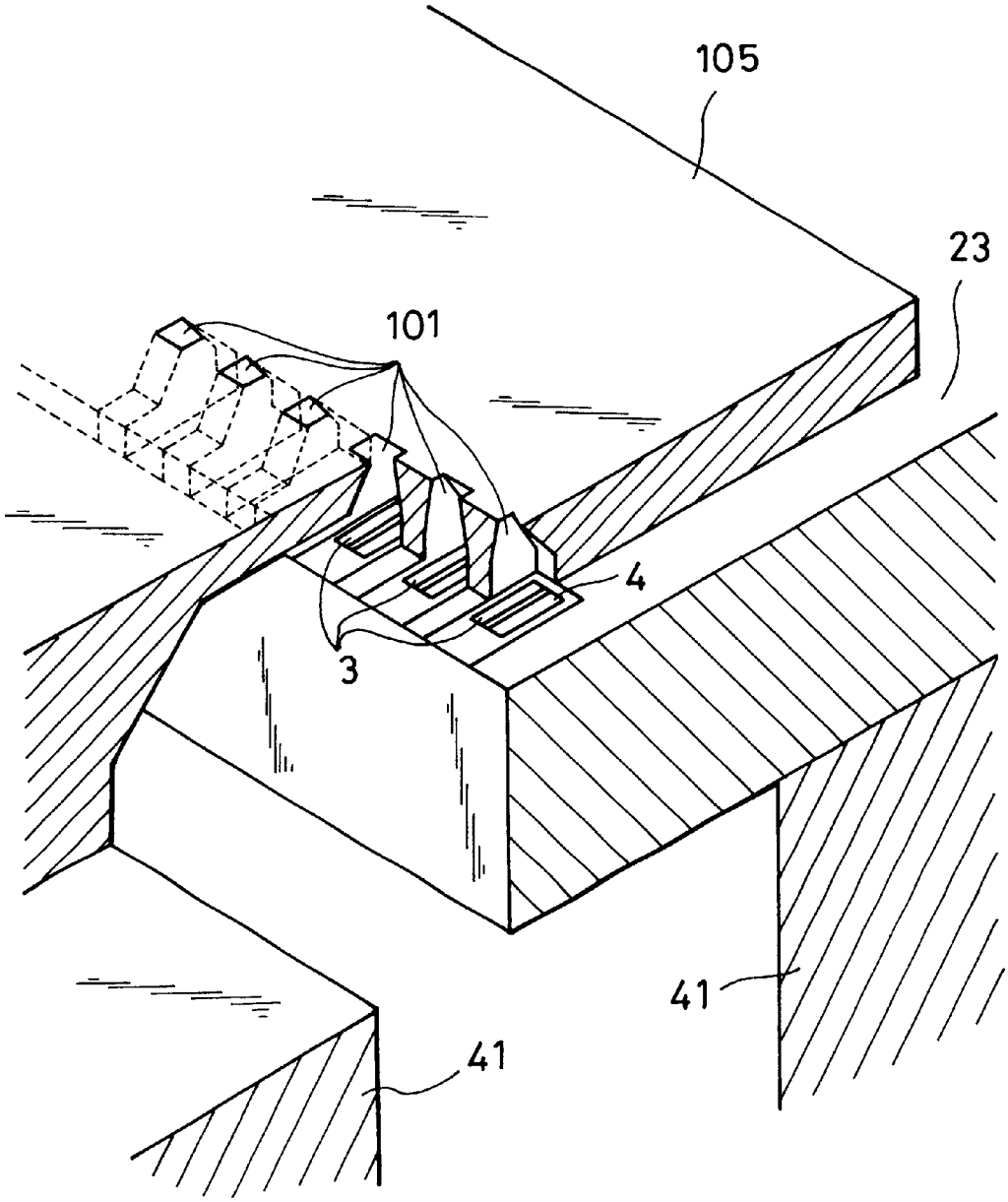
FIG. 9 is a schematic sectional view showing another example of an ink-jet recording head according to the present invention.

In this example, as shown in FIGS. 8 and 9, an ejection outlet 101 is formed in parallel to the surface of an element substrate 23 equipped with heating resistors 3 and 4, namely, opposite to the heating resistors. Similar to FIG. 3, FIG. 8 is a schematic view illustrating the ink-ejecting angle. Although an ink inlet is disposed in the direction perpendicular to the longitudinal direction of the heating resistors in this figure, it does not influence the results of this example if the inlet is disposed lying in a direction parallel to the heating resistors. FIG. 9 is a schematic perspective sectional view showing the structure of nozzles and their peripheries in this example.

According to the same calculation as illustrated in Example 1, the following equation expressing the relationship between the positions of the heating resistors and ink-ejecting direction can be obtained.

$$\theta_f = \tan^{-1}\frac{S_O S_N(\mathrm{Sin}\theta_1 + \mathrm{Sin}\theta_2)}{S_N^2 - S_O^2\mathrm{Sin}\theta_1\mathrm{Sin}\theta_2}$$

Based on this equation, an inequality $0° < \theta_f \leqq 5°$ should be satisfied in order to achieve the optimum ink-impacting position error.

As described above, false ink-impacting position when ink bubbles are generated by two electrothermal converting elements can be prevented and high image quality can be achieved in such a case where the following formula is satisfied with the angle $\theta_1$ of the areal center of a first heating resistor member relative to the areal center of an orifice in a ejection outlet portion; the angle $\theta_2$ of the areal center of a second heating resistor member relative to the same; the sectional area $S_N$ of an ink channel when the channel is sectioned perpendicular to the ink-ejecting direction; and the area $S_O$ of the orifice.

$$0° < \tan^{-1}\frac{S_N S_O(\mathrm{Sin}\theta_1 + \mathrm{Sin}\theta_2)}{S_N^2 - S_O^2\mathrm{Sin}\theta_1\mathrm{Sin}\theta_2} \leqq 5°$$

More preferably, such effects can be obtained when the following formula is satisfied.

$$0° < \tan^{-1}\frac{S_N S_O(\mathrm{Sin}\theta_1 + \mathrm{Sin}\theta_2)}{S_N^2 - S_O^2\mathrm{Sin}\theta_1\mathrm{Sin}\theta_2} \leqq 3°$$

Although two heating resistor members are disposed within one nozzle in the above examples, similar results can also be achieved, needless to say, in cases where three or more of heating resistor members are disposed within one nozzle by determining the maximum $\theta_f$ value.

What is claimed is:

1. An ink-jet head comprising:

an ejection outlet portion which has an ejection outlet having an areal center and an area $S_O$, and which is convergent toward said ejection outlet;

an ink channel having a sectional area $S_N$ and communicating with said ejection outlet;

a first heater having an areal center and a second heater having an areal center which are disposed in said ink channel and can be individually driven; and an element substrate having said first and said second heaters, wherein:

said first heater and said second heater have different heating powers and are separated from each other; and the following formula:

$$\tan^{-1}\frac{S_N S_0(\mathrm{Sin}\theta_1 + \mathrm{Sin}\theta_2)}{S_N^2 - S_0^2\mathrm{Sin}\theta_1\mathrm{Sin}\theta_2} \leq 5°$$

is satisfied with an angle $\theta_1$ formed between the areal center of said first heater and a projection point of the areal center of said ejection outlet onto a surface of the element substrate provided with said first and said second heaters via the areal center of said ejection outlet, an angle $\theta_2$ being similarly formed but using the areal center of said second heater, the sectional area $S_N$ of said ink channel being perpendicular to the ink-ejecting direction, and the area $S_O$ of said ejection outlet.

2. The ink-jet head according to claim 1, wherein the following formula:

$$\tan^{-1}\frac{S_N S_O(\mathrm{Sin}\theta_1+\mathrm{Sin}\theta_2)}{S_N^2-S_O^2\mathrm{Sin}\theta_1\mathrm{Sin}\theta_2}\leqq 3^\circ$$

is satisfied.

3. The ink-jet head according to claim 1, wherein each of the areal centers of said heaters is a center of an effective heating area.

4. The ink-jet head according to claim 1, wherein an area of said first heater is different from an area of said second heater.

5. The ink-jet head according to claim 1, wherein said angle $\theta_1$ and said angle $\theta_2$ are substantially equal.

6. The ink-jet head according to claim 1, wherein said angles $\theta_1$ is different from said angle $\theta_2$.

7. An ink-jet head comprising:

an ejection outlet portion which has an ejection outlet having an areal center and an area $S_O$, and which is convergent toward said ejection outlet;

a pressure chamber having a sectional area $S_N$ and communicating with said ejection outlet;

a first heater having an areal center and a second heater having an areal center which are provided in said pressure chamber and which are disposed so as to oppose said ejection outlet, and can be individually driven; and an element substrate having said first and said second heaters, wherein:

said first heater and said second heater have different heating powers and are separated; and the following formula:

$$\tan^{-1}\frac{S_N S_0(\mathrm{Sin}\theta_1+\mathrm{Sin}\theta_2)}{S_N^2-S_0^2\mathrm{Sin}\theta_1\mathrm{Sin}\theta_2}\leq 5^\circ$$

is satisfied with an angle $\theta_1$ formed between the areal center of said first heater and a projection point of the areal center of said ejection outlet onto a surface of the element substrate provided with said first and said second heaters via the areal center of said ejection outlet, an angle $\theta_2$ being similarly formed but using the areal center of said second heater, the sectional area $S_N$ of said pressure chamber being perpendicular to said element substrate equipped with said first and said second heaters, and the area $S_O$ of said ejection outlet.

8. The ink-jet head according to claim 1 or 7, wherein at least one of said heaters is an electrothermal converting element.

9. An ink-jet head cartridge comprising:

an ink-jet head according to claims 1 or 7;

an container holding an ink to be supplied to said ink-jet head; and supply means for supplying the ink from the ink container to the ink-jet head.

10. An ink-jet recording apparatus which records by ejecting an ink, and comprises an ink-jet head and a driving signal supplying circuit, said ink-jet head comprising:

an ejection outlet portion which has an ejection outlet having an areal center and an area $S_O$, and which is convergent toward said ejection outlet;

an ink channel having a sectional area $S_N$ and communicating with said ejection outlet;

a first heater having an areal center and a second heater having an areal center which are disposed in said ink channel and can be individually driven; and an element substrate having said first and said second heaters, said circuit supplying individual driving signals for said first heater and said second heater, wherein:

said first heater and said second heater have different heating powers and are separated; and the following formula:

$$\tan^{-1}\frac{S_N S_0(\mathrm{Sin}\theta_1+\mathrm{Sin}\theta_2)}{S_N^2-S_0^2\mathrm{Sin}\theta_1\mathrm{Sin}\theta_2}\leq 5^\circ$$

is satisfied with an angle $\theta_1$ formed between the areal center of said first heater and a projection point of the areal center of said ejection outlet onto a surface of the element substrate provided with said first and said second heaters via the areal center of said ejection outlet, an angle $\theta_2$ being similarly formed but using the areal center of said second heater, the sectional area $S_N$ of said ink channel being perpendicular to the ink-ejecting direction, and the area $S_O$ of said ejection outlet.

11. An ink-jet recording apparatus which records by ejecting an ink, and comprises an ink-jet head and a driving signal supplying circuit, said ink-jet head comprising:

an ejection outlet portion which has an ejection outlet having an areal center and an area $S_O$, and which is convergent toward said ejection outlet;

a pressure chamber having a sectional area $S_N$ and communicating with said ejection outlet;

a first heater having an areal center and a second heater having an areal center which are provided in said pressure chamber, disposed so as to oppose said ejection outlet, and can be individually driven; and an element substrate having said first and said second heaters, said circuit supplying individual driving signals for said first heater and said second heater, wherein:

said first heater and said second heater have different heating powers and are separated; and the following formula:

$$\tan^{-1}\frac{S_N S_0(\mathrm{Sin}\theta_1+\mathrm{Sin}\theta_2)}{S_N^2-S_0^2\mathrm{Sin}\theta_1\mathrm{Sin}\theta_2}\leq 5^\circ$$

is satisfied with an angle $\theta_1$ formed between the areal center of said first heater and a projection point of the areal center of said ejection outlet onto a surface of the element substrate provided with said first and said second heaters via the areal center of said ejection outlet, an angle $\theta_2$ being similarly formed but using the areal center of said second heater, the sectional area $S_N$ of said pressure chamber being perpendicular to said element substrate equipped with said first and said second heaters, and the area $S_O$ of said ejection outlet.

* * * * *

UNITED STATES PATENT AND TRADEMARK OFFICE

CERTIFICATE OF CORRECTION

PATENT NO. : 6,290,335 B1
DATED : September 18, 2001
INVENTOR(S) : Jun Kawai et al.

It is certified that error appears in the above-identified patent and that said Letters Patent is hereby corrected as shown below:

Column 1,
Line 29, "Examined Patent Publication" should read -- Laid-Open Patent Application --;
Line 46, "Inventors" should read -- inventors --;
Line 49, "causes" should read -- cause --; and
Line 58, "Inventors" should read -- inventors --.

Column 2,
Line 38, "Inventors" should read -- inventors --; and
Line 54,. "a real" should read -- area --.

Column 7,
Line 21, "these" should read -- the --.

Column 8,
Line14, "portion;" should read -- portion, --;
Line 15, "same;" should read -- same, --;
Line 17, "direction;" should read -- direction, --; and
Line 51, left margin should be closed up.

Column 9,
Line 15, "angles" should read -- angle --; and
Line 51, "an" should read -- a --.

Signed and Sealed this

Thirtieth Day of April, 2002

*Attest:*

*Attesting Officer*

JAMES E. ROGAN
*Director of the United States Patent and Trademark Office*